US012546201B2

(12) United States Patent
Cook et al.

(10) Patent No.: US 12,546,201 B2
(45) Date of Patent: Feb. 10, 2026

(54) MODULAR MANIFOLD SYSTEM FOR CONTINUOUS FLUID PUMPING INTO A WELL

(71) Applicant: FMC Technologies, Inc., Houston, TX (US)

(72) Inventors: James Cook, Houston, TX (US); Julian Keihany, Houston, TX (US); Corey Massey, Houston, TX (US); Andrew Krupa, Houston, TX (US)

(73) Assignee: FMC Technologies, Inc., Houston, TX (US)

( * ) Notice: Subject to any disclaimer, the term of this patent is extended or adjusted under 35 U.S.C. 154(b) by 0 days.

(21) Appl. No.: 18/977,845

(22) Filed: Dec. 11, 2024

(65) Prior Publication Data

US 2025/0109672 A1 Apr. 3, 2025

Related U.S. Application Data

(60) Continuation of application No. 18/476,626, filed on Sep. 28, 2023, now Pat. No. 12,203,355, which is a (Continued)

(51) Int. Cl.
*E21B 43/26* (2006.01)

(52) U.S. Cl.
CPC ..... *E21B 43/2607* (2020.05)

(58) Field of Classification Search
CPC ..... E21B 43/2607; E21B 43/26
See application file for complete search history.

(56) References Cited

U.S. PATENT DOCUMENTS 9,127,545 B2 9/2015 Kajaria et al.
10,597,991 B2 3/2020 Lopez
(Continued)

FOREIGN PATENT DOCUMENTS

CA 2649203 A1 6/2010
WO 2021003178 A1 1/2021

OTHER PUBLICATIONS

Office Action issued in United Arab Emirates Application No. P6001851/2022 (7 pages).
(Continued)

*Primary Examiner* — Shane Bomar
(74) *Attorney, Agent, or Firm* — Erise IP, P.A.

(57) ABSTRACT

An illustrative modular manifold system includes, among other things, two or more modular pump manifolds, a low-pressure header, and a main high-pressure manifold. Modular pump manifolds may include a low-pressure manifold for supplying fracturing fluid or water to pumps, a high-pressure manifold for supplying fracturing fluid or water to one or more wells and a bleed-off/prime-up manifold. Each modular pump manifold of the modular manifold system is configured to be fluidly isolatable from the other modular pump manifolds. Each isolated modular pump manifold is configured to be flushed with water, bled off and primed up independently of the other modular pump manifolds. After the bleed off, maintenance procedures may be performed on pumps associated with the isolated modular pump manifold. The modular pump manifolds that are not isolated may continue in active fracing stage operations while a modular pump manifold is isolated.

20 Claims, 8 Drawing Sheets

Related U.S. Application Data division of application No. 17/475,181, filed on Sep. 14, 2021, now Pat. No. 11,808,126.

(56) References Cited

U.S. PATENT DOCUMENTS

| | | | | |
|---|---|---|---|---|
| 11,041,579 | B2 | 6/2021 | Lopez et al. | |
| 12,055,025 | B2 * | 8/2024 | Bull | F16L 25/009 |
| 12,281,557 | B1 * | 4/2025 | Warren | E21B 43/267 |
| 12,312,928 | B2 * | 5/2025 | Bull | E21B 41/0021 |
| 2014/0290768 | A1 | 10/2014 | Randle et al. | |
| 2018/0003323 | A1 | 1/2018 | Kendrick | |
| 2018/0007330 | A1 | 1/2018 | Hajjar | |
| 2018/0073308 | A1 | 3/2018 | Tran et al. | |
| 2018/0283102 | A1 | 10/2018 | Cook | |
| 2018/0307255 | A1 | 10/2018 | Bishop | |

OTHER PUBLICATIONS

Office Action issued in corresponding Application No. 122440209 mailed on Mar. 17, 2025 (10 pages).

U.S. Appl. No. 96/050,116, Reasons for Substantial New Question Determination for Supplemental Examination of U.S. Pat. No. 11,808,126, mailed Dec. 11, 2025.

U.S. Appl. No. 96/050,116, Request for Supplemental Examination of U.S. Pat. No. 11,808,126, filed Nov. 13, 2025.

* cited by examiner

MODULAR MANIFOLD SYSTEM FOR CONTINUOUS FLUID PUMPING INTO A WELL

TECHNICAL FIELD

Generally, the present disclosure relates to a modular system and manifold banks with flushing, pump isolation and access functionalities in the active fracing stage introducing fluids into a well.

BACKGROUND

Oil and gas wells are formed by drilling a hole into a geological formation where hydrocarbons (oil and/or gas) are located. In some cases, hydrocarbon production from an existing well may decrease over time and various actions may be utilized to increase the production from the well. For example, a hydraulic fracturing process (also known as a "fracing" operation) may be performed on wells to increase hydrocarbon production. In other cases, fracturing operations may be performed on new wells. For example, fracturing operations may be performed on brand new wells extending very deep (e.g., 10,000-20,000 feet) into the earth since, at such depths, the formation may not exhibit sufficient permeability and porosity to allow oil and gas to flow naturally from the formation into the well at rates sufficient to economically justify drilling the well.

In general, hydraulic fracturing operations involve pumping a fracturing fluid (frac fluid) under high pressure into the formation for purposes of creating cracks in the formation to thereby create fluid flow paths from the well to a larger area of the reservoir that contains the hydrocarbons to be produced. More specifically, a hydraulic fracture is formed by pumping a fracturing fluid into the well at a rate sufficient to increase the pressure downhole to a value that is greater than the fracture gradient of the formation. The pressure of the fracturing fluid causes the formation to crack, thereby allowing the fracturing fluid to enter and extend the crack further into the formation. The fracturing fluid can comprise any type of fluid, ranging from water to gels, foams, nitrogen, carbon dioxide, or air in some cases along with different forms of diluted acid. To keep the fractures in the formation open after the fracture is initially formed, so-called propping agents or "proppants" (typically small spheres generally composed of quartz sand grains, ceramic spheres or aluminum oxide pellets) are introduced into the fracturing fluid and pumped into the fractures to extend the fractures and pack them with proppants. At a very basic level, the proppants act to keep the fracture "propped" open when the pressure on the fracturing fluid is eliminated or reduced. Typically, the proppant is made of a material that is higher in permeability than the surrounding formation. Accordingly, the propped hydraulic fracture becomes a high permeability conduit through which the formation fluids can flow into the well.

In general, to create sufficiently high pressure to create cracks in the formations at great depths requires a plurality of fracing pumps (frac pumps). A multitude of hoses and piping are attached upstream and downstream of these pumps and direct the flow of the fracturing fluid to the wellbore. The management of these pumps and associated hoses, pipes, pipelines, and other equipment creates challenges for an operator. For example, it is often necessary to interrupt fracing stage operations to investigate a malfunction or to perform necessary repairs on pumps. This leads to nonproduction time that wastes money and leads to budget overruns in the fracturing operations.

A pump that requires repairs or maintenance during the fracing stage cannot be isolated from the fracing system and brought back online into an active fracing stage. This is because the high pressure in the fracing system cannot be bled off, and the pump cannot be reprimed and pressure tested, independently of the frac spread. After the fracing stage is complete, the entire system is de-energized to allow access to the pumps. Once the high pressure in the system has been bled off, the operator may access the pumps and perform pump maintenance such as repairing or replacing valves, seats, packing, pumps and high pressure/low pressure lines. After completing repairs, the operator will typically perform a pump prime-up sequence and pressure tests of the system before the fracing stage can recommence. Another major issue is caused by the proppant/sand that is used in fracing operations. The proppant/sand can accumulate in the pumps, lines and valves, especially if the pump is shut down during the fracing stage because the pumps cannot be flushed with water during the active fracing stage, and such buildup may cause issues on re-start.

The nonproduction time required in current operations is especially problematic because the fracing industry demands as much pump up-time as possible. For example, even increasing from eighteen to nineteen hours per day in pumping time is a major benefit because of the added productivity time. Further, operators are constantly instructed to find methods and alternatives to increase productive pump up-time.

SUMMARY

The following presents a simplified summary of the subject matter disclosed herein in order to provide a basic understanding of some aspects of the information set forth herein. This summary is not an exhaustive overview of the disclosed subject matter. It is not intended to identify key or critical elements of the disclosed subject matter or to delineate the scope of various embodiments disclosed herein. Its sole purpose is to present some concepts in a simplified form as a prelude to the more detailed description that is discussed later.

Generally, the present disclosure is directed toward solutions that increase productivity by increasing pump time, and are of great benefit to the industry. More specifically, embodiments herein are directed toward a new manifold system that increases productive pump up time by providing each modular pump manifold the functionality to be flushed, isolated, bled-off, reprimed, and pressure tested while the other modular pump manifolds are in the active fracing stage. These functionalities allow pump maintenance operations to occur simultaneously to the fracing stage and also allow an operator to replace or bring frac pumps back online into an active fracing stage at any time. The new manifold system also allows an operator to feed each modular pump manifold with water on demand to perform either flushing or prime up operations.

The present disclosure gives better parallel maintenance and repair functionalities during the introduction of fluids into a well, such as performing fracturing operations on oil and gas wells that may solve or at least reduce the effects of one or more of the problems identified above.

One illustrative modular manifold system disclosed herein includes, among other things, modular pump manifolds that includes one or more pumps, a low-pressure header that selectively distributes fracturing fluid and/or water to the modular pump manifolds and to low pressure inlets of the one or more pumps associated with a respective manifold, a high-pressure manifold that receives discharge from the one or more pumps of a respective manifold, and a main high-pressure manifold that receives discharge from high pressure manifolds and is fluidly connected to one or more wells Another illustrative modular manifold system disclosed herein includes one or more modular pump manifolds, including among other things, a low-pressure manifold that supplies fracturing fluid or clean water to a suction side of frac pumps, a high-pressure manifold that receives discharge from frac pumps, and a bleed off/prime up manifold that bleeds off pressure from the high-pressure manifold and primes up pressure in the high-pressure manifold.

Also disclosed herein is a method that includes, among other things, supplying fracturing fluid to modular pump manifolds where each modular pump manifold is connected to pumps, increasing the fracturing fluid pressure using the pumps to supply a high pressure fracturing fluid to a main high-pressure manifold, discontinuing supply of the fracturing fluid to a first modular manifold of the modular manifolds while continuing to supply the fracturing fluid to other modular manifolds, and fluidly isolating the first manifold from the main high-pressure manifold.

BRIEF DESCRIPTION OF DRAWINGS

Certain aspects of the presently disclosed subject matter will be described with reference to the accompanying drawings, which are representative and schematic in nature and are not be considered to be limiting in any respect as it relates to the scope of the subject matter disclosed herein.

Figure 1:
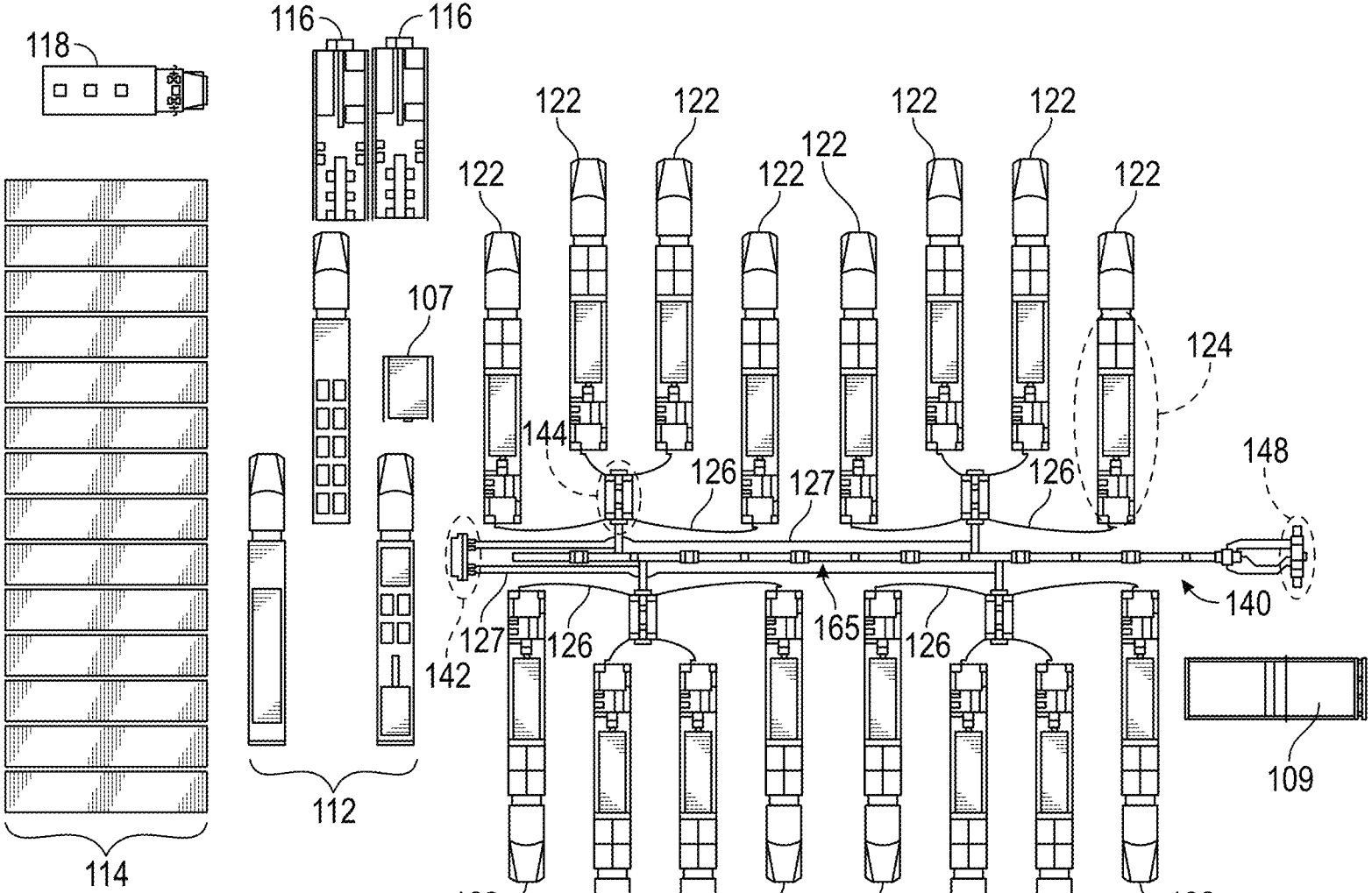
FIG. 1 is a simplistic plan view of one illustrative embodiment of a modular system and manifolds disclosed herein for use in introducing fluids into oil and gas wells when employed in a well fracturing operation.

While the subject matter disclosed herein is susceptible to various modifications and alternative forms, specific embodiments thereof have been shown by way of example in the drawings and are herein described in detail. It should be understood, however, that the description herein of specific embodiments is not intended to limit the disclosed subject matter to the particular forms disclosed, but on the contrary, the intention is to cover all modifications, equivalents, and alternatives falling within the spirit and scope of the disclosed subject matter as defined by the appended claims.

DESCRIPTION OF EMBODIMENTS

Various illustrative embodiments of the disclosed subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present subject matter will now be described with reference to the attached figures. Various structures, systems and devices are schematically depicted in the drawings for purposes of explanation only and so as to not obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase. With reference to the attached figures, various illustrative embodiments of the systems, devices and method disclosed herein will now be described in more detail.

FIG. 1 is a plan view of one illustrative embodiment of a modular system 100 disclosed herein in the context where the system 100 is used to perform fracturing operations on a well. FIG. 1 depicts one illustrative example of how various items of equipment that are typically employed in fracturing operations may be arranged and positioned on-site when performing a fracturing operation using the novel modular system 100 disclosed herein. In general, the equipment used in hydraulic fracturing operations using the novel modular system 100 includes, among other things, a blender, hydration unit and chemical trailer (collectively indicated by the reference numeral 112), a plurality of proppant or sand containers 116, a plurality of water tanks 114, a data monitoring van 118, an open tank 109, a plurality of pump trucks 122 each of which has a schematically-depicted high-pressure frac pump 124 and a boost pump 107. In the depicted example, there is a total of sixteen such pump trucks 122—eight on each side of the illustrative example of the modular manifold system 140 depicted herein. In general, the system 140 comprises a low-pressure header 142, a plurality of modular pump manifolds 144 (four of which are depicted in FIG. 1), a plurality of connecting manifold spacing spools forming a main high-pressure manifold 165 that provide fluid communication between adjacent modular pump manifolds 144 and a simplistically depicted oil/gas well 148. As described more fully below, each of the modular pump manifolds 144 comprises a high-pressure manifold 160 and a low-pressure manifold 170, both of which are mounted on a structural support frame 150.

The following is a brief high-level description of certain operational aspects of the illustrative system 100 depicted herein. During fracturing operations, the blender 112 is adapted to prepare or mix the fracturing fluid to be injected into the well 148. The blender 112 may receive a fluid, e.g., water from the water tanks 114, and various chemical additives and/or proppants/sand and mix all of these materials together. The final fracturing fluid is provided from the blender 112 to the low-pressure header 142. The fracturing fluid is then supplied to the low-pressure manifold 170 (see FIG. 2) on each of the modular pump manifolds 144 via a dedicated low-pressure flow line 127 for each of the modular pump manifolds 144. The low-pressure fracturing fluid is supplied from the low-pressure manifold 170 on each of the modular pump manifolds 144 to four of the frac pumps 124 via various low-pressure flow lines (not shown). The fluid in the low-pressure manifold 170 is adapted to be supplied to the suction side of the frac pumps 124 positioned on the pump trucks 122 via the low-pressure frac fluid outlets (not shown) and a plurality of low-pressure flow lines (not shown) extending from the low-pressure frac fluid outlets of the flow distribution manifold (not shown) to the pumps 124. In an example embodiment, the low-pressure manifold 170 may further comprise a blinded outlet that may be opened to inspect the internals of the low-pressure manifold 170. The frac pumps 124 are operated so as to generate a high-pressure fracturing fluid that is injected into and received by the high-pressure manifold 160 on each of the modular pump manifolds 144 via various high-pressure flow lines 126. The high-pressure fracturing fluid flows from each of the modular pump manifolds 144 through the isolation valve 168 (see FIG. 4) and then through the main high-pressure manifold 165 to the high-pressure frac fluid outlet where it is injected into the well 148. More details as to the operation functionalities and structures of the various embodiments of the modular pump manifolds 144 and systems 140 will be disclosed more fully below.

Figure 3A:
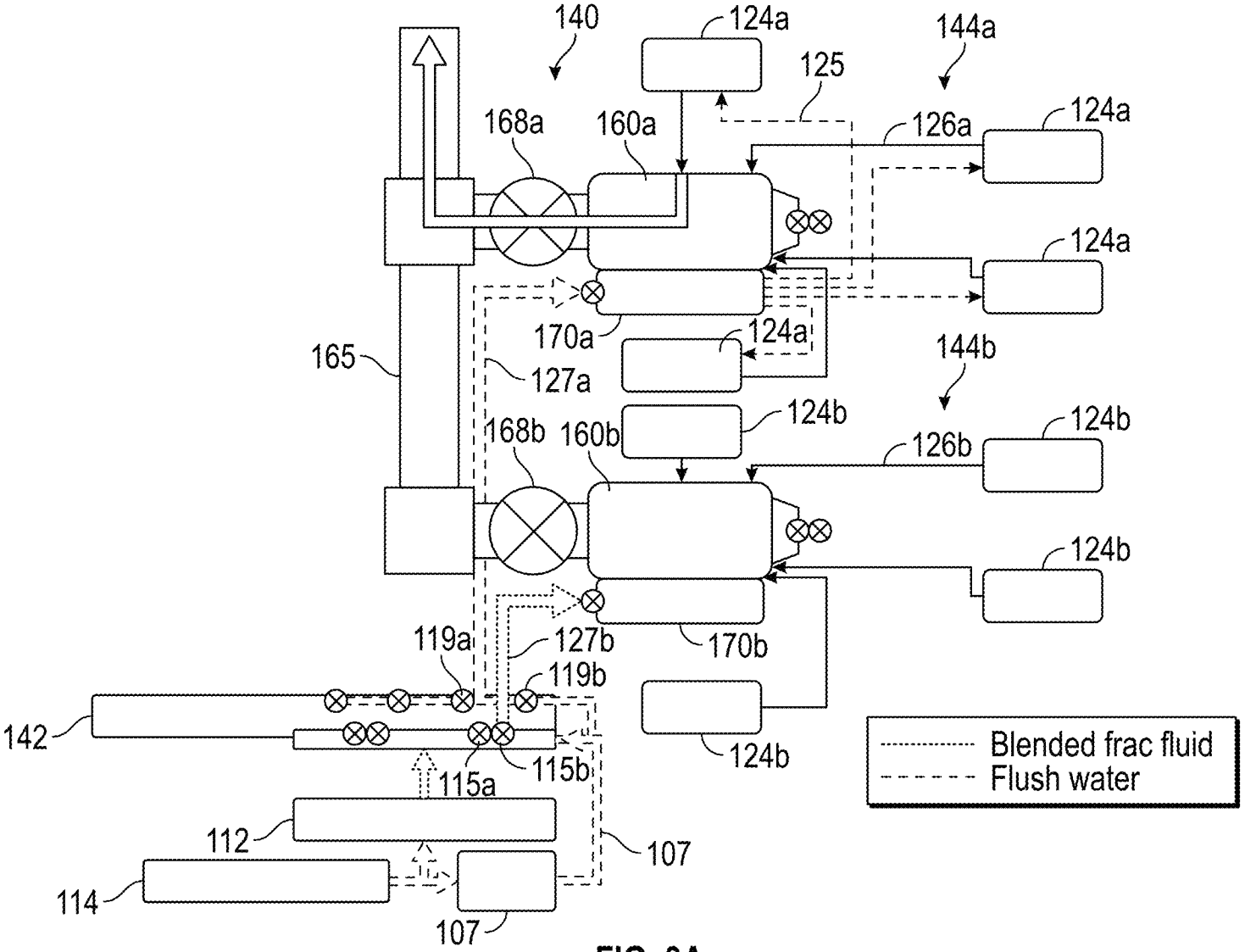
FIG. 3*a* is a schematic view of one illustrative embodiment of a modular manifold system with the flushing functionality and structure disclosed herein.
Figure 3B:
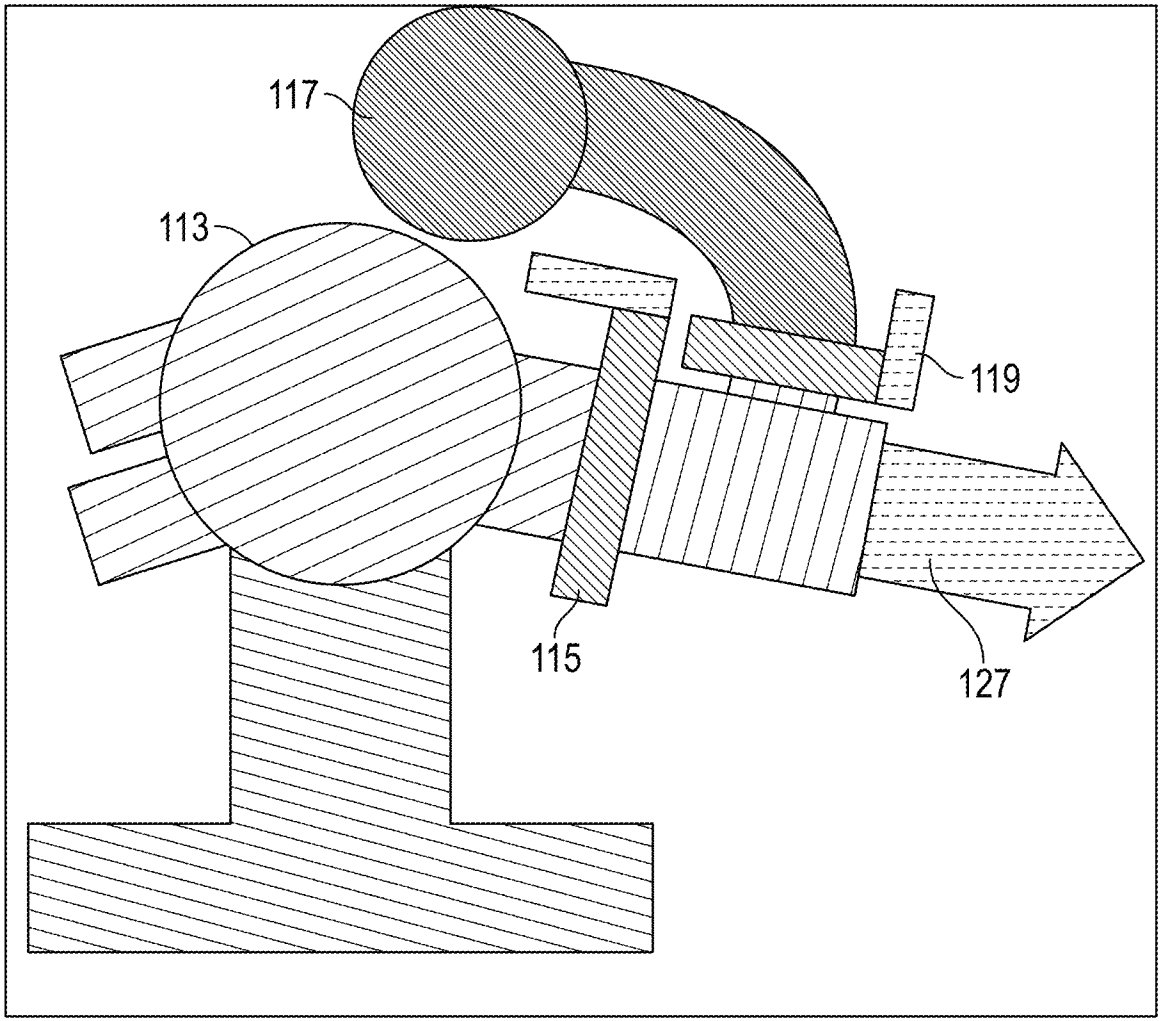
FIG. 3*b* is a schematic view of the illustrative embodiment of a modular manifold system with the flushing functionality and structure disclosed herein.

Water from the water tanks 114 that is received by the blender 112 may be supplied to the low-pressure manifold 170 of a particular modular pump manifold 144 by a boost pump 107 through the dedicated low-pressure flow line 127 of the particular modular pump manifold 144 for clean water flushing operations (see FIGS. 3*a* and 3*b*). The flushing operation may occur simultaneously with fracing operation as the other modular pump manifolds 144 may continue in the active fracing stage because they have their own dedicated low-pressure flow lines 127.

Figure 2:
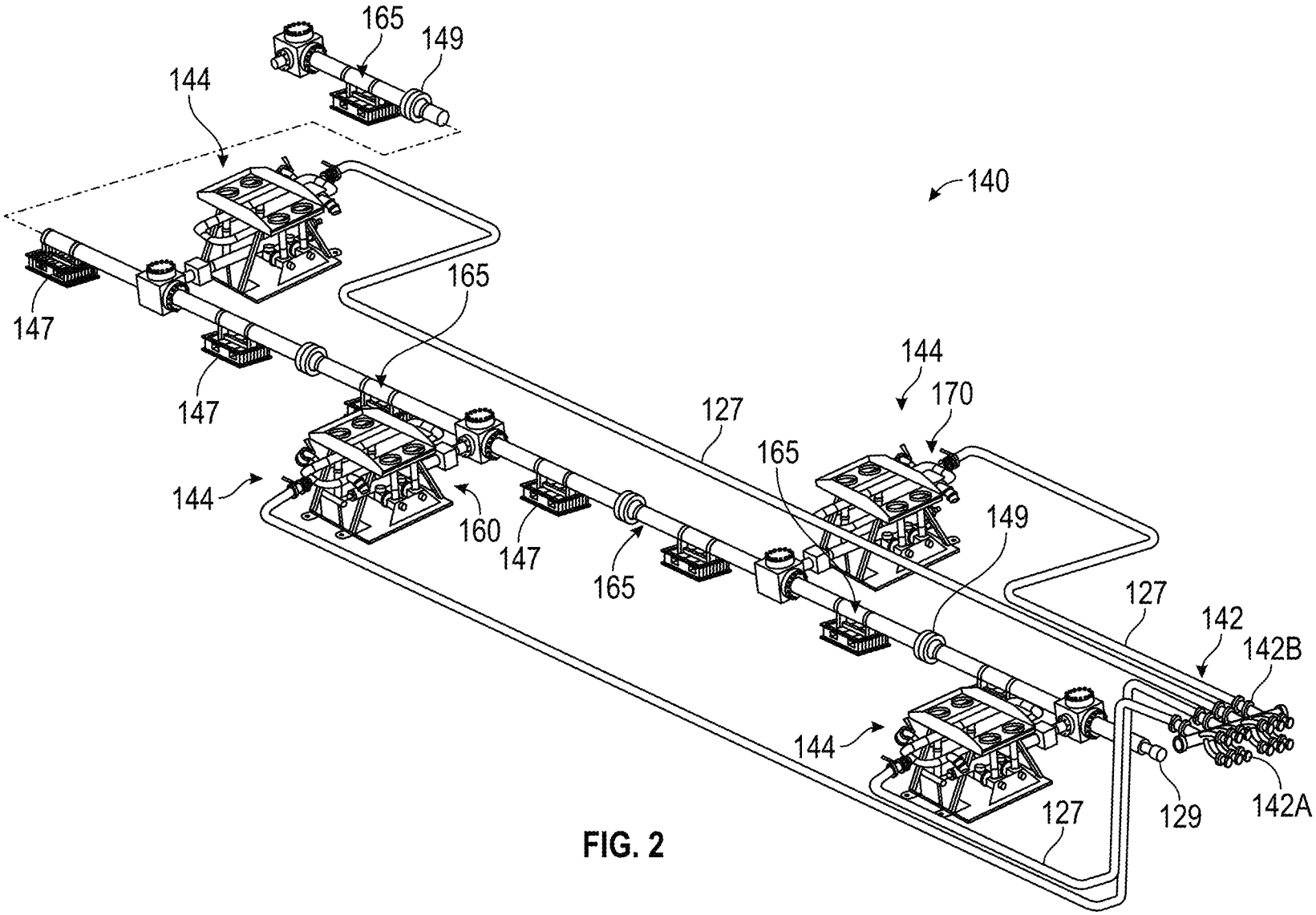
FIG. 2 is a perspective view of one illustrative arrangement disclosed herein for a modular system and a plurality of modular pump manifolds for use in introducing fluids into oil and gas wells.

FIG. 2 is a perspective view of one illustrative arrangement disclosed herein of a modular manifold system 140 that may be employed when injecting fluid into a well, e.g., during fracturing operations. In the examples depicted herein, the modular manifold system 140 is depicted with four illustrative modular pump manifolds 144, wherein each of the modular pump manifolds 144 is configured and adapted to be operatively connected to four illustrative pump trucks 122. The pump trucks may be placed in a variety of configurations, for example, four pump trucks may be positioned around and connected to a modular pump manifold 144, as illustrated; in other embodiments, two or more pump trucks 122 may be positioned proximate each of the modular pump manifolds 144 and connected thereto. Of course, as will be appreciated by those skilled in the art after a complete reading of the present application, the modular manifold system 140 is very flexible in terms of how it is arranged and configured for use in a particular application. Additionally, the modular manifold system 140 may be comprised of any desired (or necessary) number of individual modular pump manifolds 144, as the system 140 may be extended by simply adding more modular pump manifolds 144 and more sections of the connecting manifold spacing spools forming the main high-pressure manifold 165.

Also depicted are a plurality of illustrative mechanical support structures 147 that are positioned where needed to mechanically support the main high-pressure manifold 165. Also note that, in the depicted example, main high-pressure manifold 165 may in fact comprise a plurality of piping spools that are coupled to one another by a flanged connection 149. In other embodiments, the main high-pressure manifold 165 may be a single piping spool with flanged connections on either end for mating with corresponding flanged connections of adjacent modular pump manifolds 144.

As mentioned above, the low-pressure fracturing fluid is supplied from the low-pressure header 142 to the low-pressure manifold 170 on each of the modular pump manifolds 144 via a dedicated low-pressure flow line 127. As mentioned above, a low-pressure header 142 can also be used to supply clean water to the low-pressure manifold 170 in flushing operations. In some embodiments, the low-pressure header 142 may serve as a "crossover" manifold in that it has twelve inlet nozzles 142A (e.g., 4-inch nozzles) and four outlet nozzles (e.g., 6-inch nozzles). It should also be noted that the modular pump manifold 144 that is positioned closest to the low-pressure header 142 will typically have a series of valves, as indicated by the reference numeral 129, operatively coupled to one end of the high-pressure manifold 160 on that particular modular pump manifold 144. The valves 129 may serve a variety of purposes, e.g., a connection for priming the frac pumps 124, to provide a connection point back to the blender 112, etc. Of course, the valves 129 may be removed as needed to access the flow path defined by the plurality of modular pump manifolds 144 and the main high-pressure manifold 165. Each high-pressure manifold 160 is connected to the main high-pressure manifold 165 via an isolation valve 168 (see FIG. 4) that allows the individual isolation of the particular high-pressure manifold 160 from the main high-pressure manifold 165. Frac pumps generate a high-pressure fracturing fluid that is injected into and received by the high-pressure manifold 160 on each of the modular pump manifolds 144 via various high-pressure flow lines 126.

FIG. 3*a* is a simple schematic illustrative of an arrangement disclosed herein of the system 140 with flushing functionality. In general, the system 140, comprises a low-pressure header 142 that receives frac fluid from a blender 112 by a flow line. The blender 112 creates slurry of frac fluid by mixing clean water from water tanks 114 with proppant/sand and other chemicals (not shown) and supplies the slurry to the low-pressure header 142 by a flow line. The frac fluid may be distributed from the low-pressure header 142 to each modular pump manifold 144 (144*a*, 144*b*, etc.) via its own dedicated low-pressure flow line 127 (127*a*, 127*b*, etc.). The low-pressure header 142 may comprise frac fluid header 113 (see FIG. 3*b*) with a frac fluid discharge valve 115 between the frac fluid header 113 and each dedicated low-pressure flow line 127. In an example embodiment, the frac fluid discharge valve 115 may be a butterfly valve, however it will be appreciated by those skilled in the art that other types of valves and equipment may be used to accomplish this function. The frac fluid discharge valve 115 associated with each low-pressure flow line 127 may be downstream of the frac fluid low-pressure header 113. The frac fluid discharge valve 115 may be actuated so as to open or actuated so as to close and turn the supply of frac fluid flow through a dedicated low-pressure flow line 127 to a particular modular pump manifold 144 on or off.

A pump 107 may be used to supply clean water directly from the water tanks 114 to the low-pressure header 142 by a dedicated water flow line 108 that bypassed the blender 112. In an example embodiment, the pump 107 used supply the clean water is a boost pump. The low-pressure header 142 may further comprise a water header 117 with a water discharge valve 119 between the water header 117 and each dedicated low-pressure flow line 127. The pump 107 may supply clean water to the water header 117. In an example embodiment the water valve 119 may be a butterfly valve. The water header 117 and water discharge valve 119 may be downstream of the frac fluid header 113 and the frac fluid discharge valve 115. In this manner, a clean water flow may be supplied through a dedicated low-pressure flow line 127*a* to a particular modular pump manifold 144*a* by closing the associated frac fluid discharge valve 115 located upstream of the respective clean water low-pressure header 117*a* and opening the associated clean water valve 119. In this way, the low-pressure headers 113, 117 allows each low-pressure outlet to be selectable between the frac fluid from the blender 112 or a clean water from the water tanks 114. In an embodiment, the low-pressure outlet and low-pressure flow lines may be 6 inch lines, however it will be readily apparent to those skilled in the art that other sizes may be used.

As an example, an operator may want to flush the frac pumps 124 connected to particular modular pump manifold 144*a* that are active in the fracing stage, having frac fluid slurry flowing from the header 117 to the frac pumps 124 of the modular pump manifold 144*a*. The operator will close the discharge butterfly valve 115*a* associated with the slurry feed to modular pump manifold 144*a* to stop the flow of the frac fluid from the frac fluid low-pressure header 113. The operator will open the clean water butterfly valve 119*a* to start the flow of clean water from the clean water low-pressure header 117. The clean water will flow to the low-pressure manifold 170*a* of a particular modular pump manifold 144*a* through the dedicated low-pressure flow line 127*a*. Next, the clean water is received by the specific frac pumps 124 that are connected via low-pressure flow lines 125 to the low-pressure manifold 170*a* of particular modular pump manifold 144*a*. The water is pressurized and flushed through the frac pumps 124 to the high-pressure manifold 160*a* on the particular modular pump manifold 144*a* via various high-pressure flow lines 126*a*. The pressurized water exits the high-pressure manifold 160*a* via an open isolation valve 168*a* (see FIG. 4) and into the well (not shown) via the main high-pressure manifold 165.

The other modular pump manifolds 144*b* and associated pumps in the system 140 may continue in the active fracing stage while a particular set of frac pumps 124*a* in a particular modular pump manifold 144*a* are flushed. As an example, modular pump manifold 144*b* is in the fracing stage while modular pump manifold 144*a* is being flushed. The discharge butterfly valve 115*b* that allows the flow of the frac fluid from the frac fluid low-pressure header 113 is open and the clean water butterfly valve 119 is closed. The frac fluid will flow to the low-pressure manifold 170*b* of a modular pump manifold 144*b* through the dedicated low-pressure flow line 127*b*. The frac fluid is received by the frac pumps 124*b* that are connected via low-pressure flow lines to the low-pressure manifold 170*b* of the modular pump manifold 144*b*. The frac fluid is pressurized and flushed through the frac pumps 124*b* to the high-pressure manifold 160*b* on the modular pump manifold 144*b* via various high-pressure flow lines 126*b*. The pressurized frac fluid exits the high-pressure manifold 160*b* via an isolation valve 168*b* that is actuated so as to be open, and into the well (not shown) via the main high-pressure manifold 165.

The flushing functionality allows any modular pump manifold 144 to be flushed during the active fracing stage with clean water. Isolation valve 168 (a/b) also allow for the pressure to be bled off the system for pump maintenance. The clean water removes proppant/sand and debris from the pump lines prior to shutting down frac pumps 124 of a modular pump manifold 144 or as part of a maintenance schedule to clean the frac pumps 124 and the modular pump manifold 144. Once a modular pump manifold 144 is flushed, an operator may actuate to close the high-pressure mainline isolation valve 168 to isolate the modular pump manifold 144 from the rest of the frac spread. The associated valve 119 may also be closed, thereby fully isolating the modular pump manifold 144 from fluid flow (low pressure slurry or clean water via lines 127 as well as high-pressure fluid from main high-pressure manifold 165. Pressure may then be bled off the system and maintenance, replacement or other necessary actions may be performed on the pumps 124, associated motors, valves, etc. In an embodiment, the boost pump 107 supplying water during flushing may be shut down or a valve at either the low-pressure manifold 170 or the water header 119 may be closed before the bleed off. Embodiments of the present disclosure may uniquely allow for "in place" maintenance to be performed. Fully pressurized frac equipment poses a risk to nearby personnel. To avoid that risk, personnel stay out of a "red zone" area typically defined as a fixed number of feet adjacent to pressurized equipment. By isolating an entire modular pump manifold, and all of the pumps connected to it, the "red zone" area is significantly reduced, such that personnel can reach the pump trucks and other equipment to perform maintenance operations without having to disconnect the equipment and move it elsewhere. In contrast, isolating a single pump truck may only reduce the "red zone" enough to allow the pump truck to be disconnected and moved. Even though "in place" maintenance is possible using embodiments present in the disclosure, it is also possible that a pump truck may be disconnected from an isolated modular pump manifold 144 and a new pump truck connected. Other routine maintenance may also be performed when isolated. As the ability to isolate the modular pump manifolds 144 allows for maintenance while the remaining manifolds are in operation, fracing may continue during the maintenance, and up-time is increased; further, a routine maintenance of pumps may allow a greater overall up-time as compared to systems which operate pumps to failure before maintenance or replacement.

Figure 4:
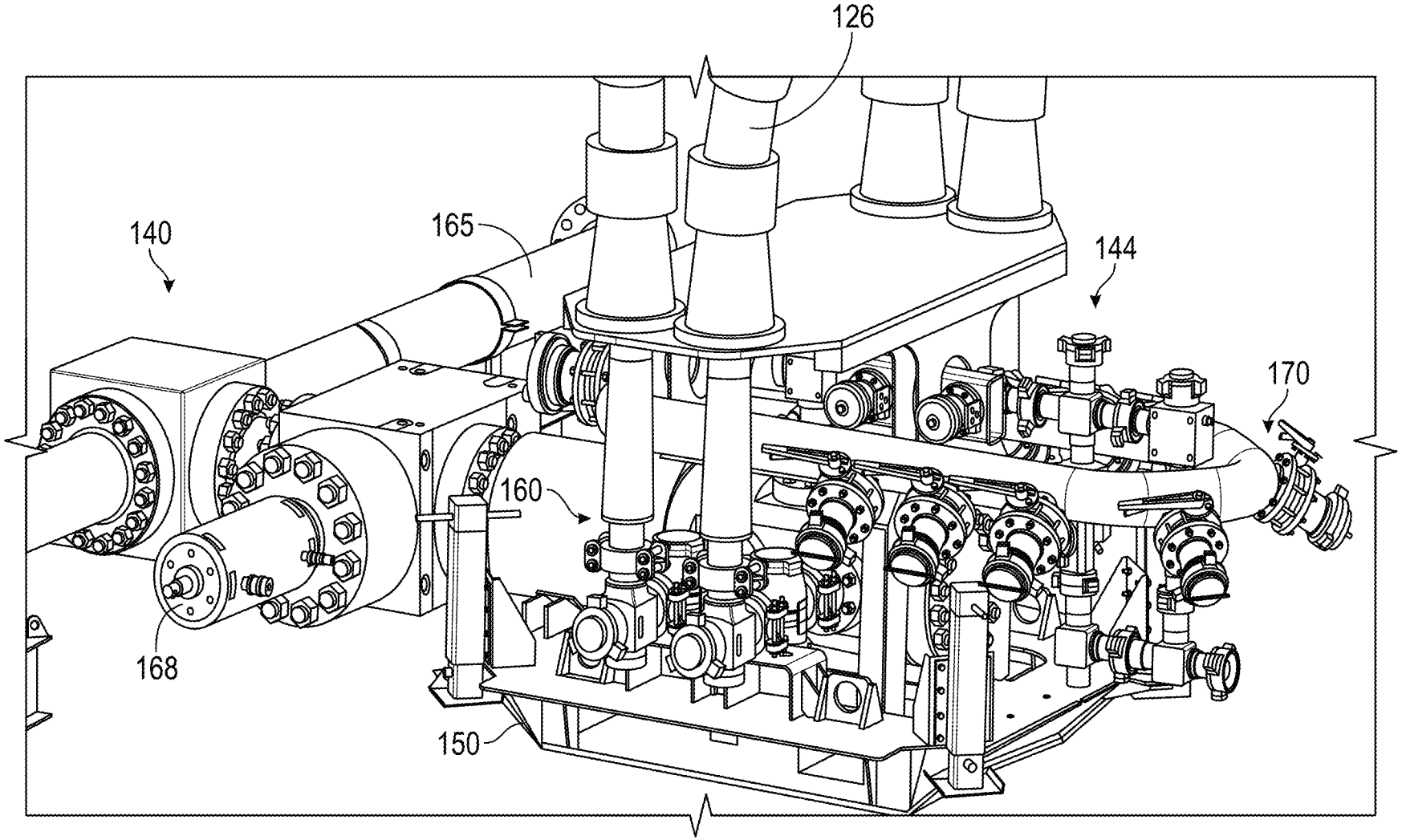
FIG. 4 is a perspective view of one illustrative embodiment of a modular pump manifold with the isolation functionality and structure disclosed herein.

FIG. 4 is a perspective view of one illustrative arrangement disclosed herein of a modular manifold system 140 having a modular pump manifold 144 with isolation functionality. Each of the modular pump manifolds 144 of a modular manifold system 140 includes a high-pressure manifold 160 and a low-pressure manifold 170, both of which are mounted on a structural support frame 150. The structural support frame 150 may be of any desired configuration so long as it is able to support the high-pressure manifold 160 and the low-pressure manifold 170 and all operational loads. The modular pump manifolds 144 depicted herein may be positioned on the ground during operation or they may be positioned on another structure, such as a flatbed trailer. The physical size of the modular pump manifolds 144 may vary depending upon the application.

Each high-pressure manifold 160 is connected to the main high-pressure manifold 165 of the modular manifold system 140 via an isolation valve 168 that allows fluid communication between adjacent modular pump manifolds 144 and the main high-pressure manifold 165. In one illustrative embodiment, the isolation valve is a large bore isolation valve 168 that may be actuated so as to stop the flow of high-pressure fluid from the high-pressure manifold 160 to the main high-pressure manifold 165. When the large bore isolation valve 168 of a particular modular pump manifold 144 is actuated to stop the flow of high-pressure fluid from the high-pressure manifold 160 of that particular modular pump manifold 144 to the main high-pressure manifold 165, that particular modular pump manifold 144 is isolated from the rest of the modular manifold system 140. The other modular pump manifolds 144 of the modular manifold system 140 may simultaneously continue in the active fracing stage while the particular modular pump manifold 144 is isolated. The isolation of a particular modular pump manifold 144 allows operators to access the modular pump manifold 144 safely while the other modular pump manifolds 144 continue in the active fracing stage.

In an example embodiment, the isolation valve 168 may be a 7-inch gate valve however, the isolation valve 168 may be of different sizes. In another example embodiment, a 4-inch gate valve, a 4-inch hydraulic plug valve or a 4-inch check valve may be utilized. A 4-inch valve may be desirable because the flow rate capacity is less in a modular pump manifold 144 because fluid from =fewer frac pumps 124 is consolidated in the modular pump manifold 144. In an example embodiment, a modular pump manifold 144 may be consolidating fluid from only two to four pumps.

Figure 5:
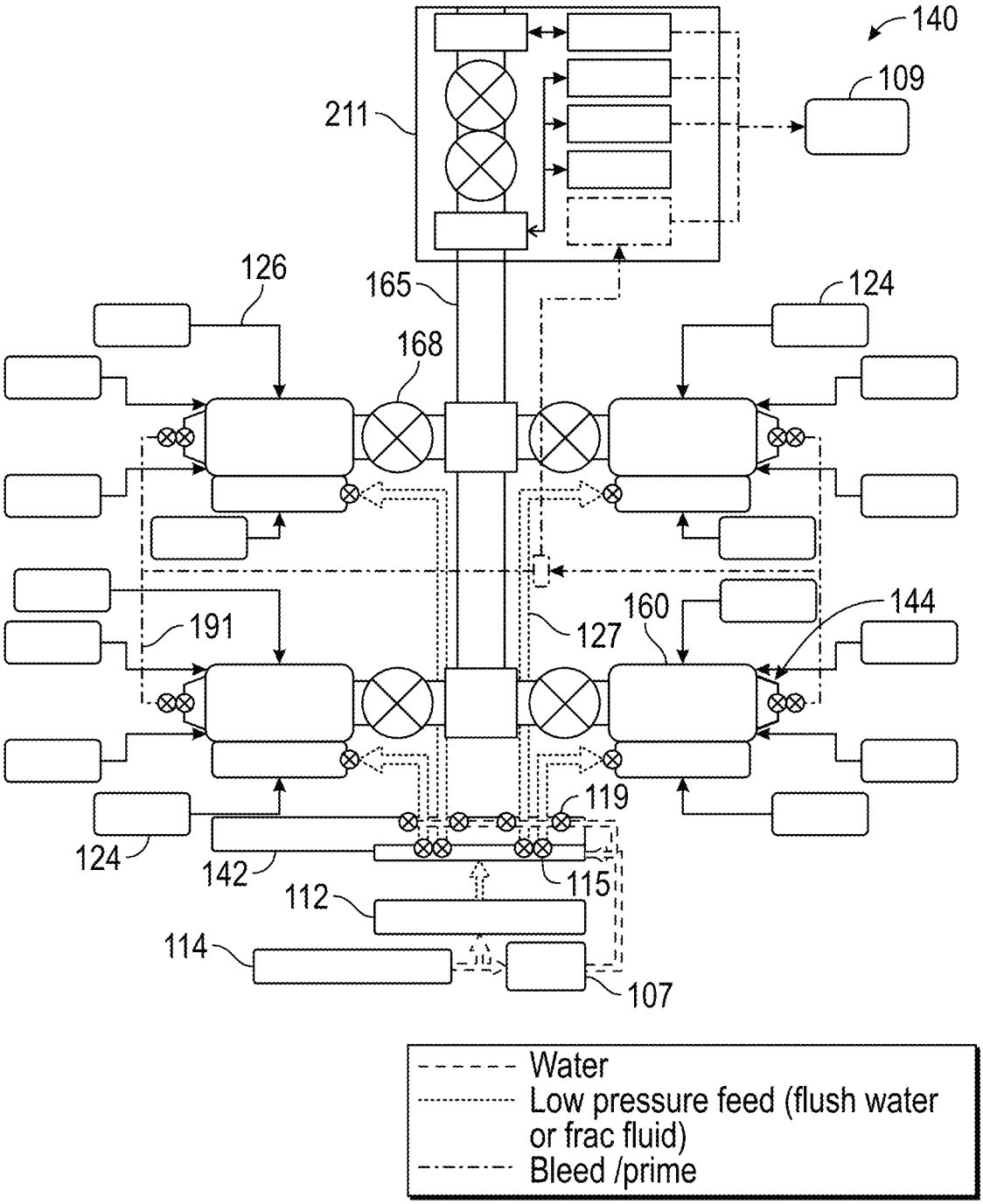
FIG. 5 is a schematic view of the illustrative of one illustrative embodiment of a modular manifold system with the bleed off and prime up functionality and structure disclosed herein.
Figure 6:
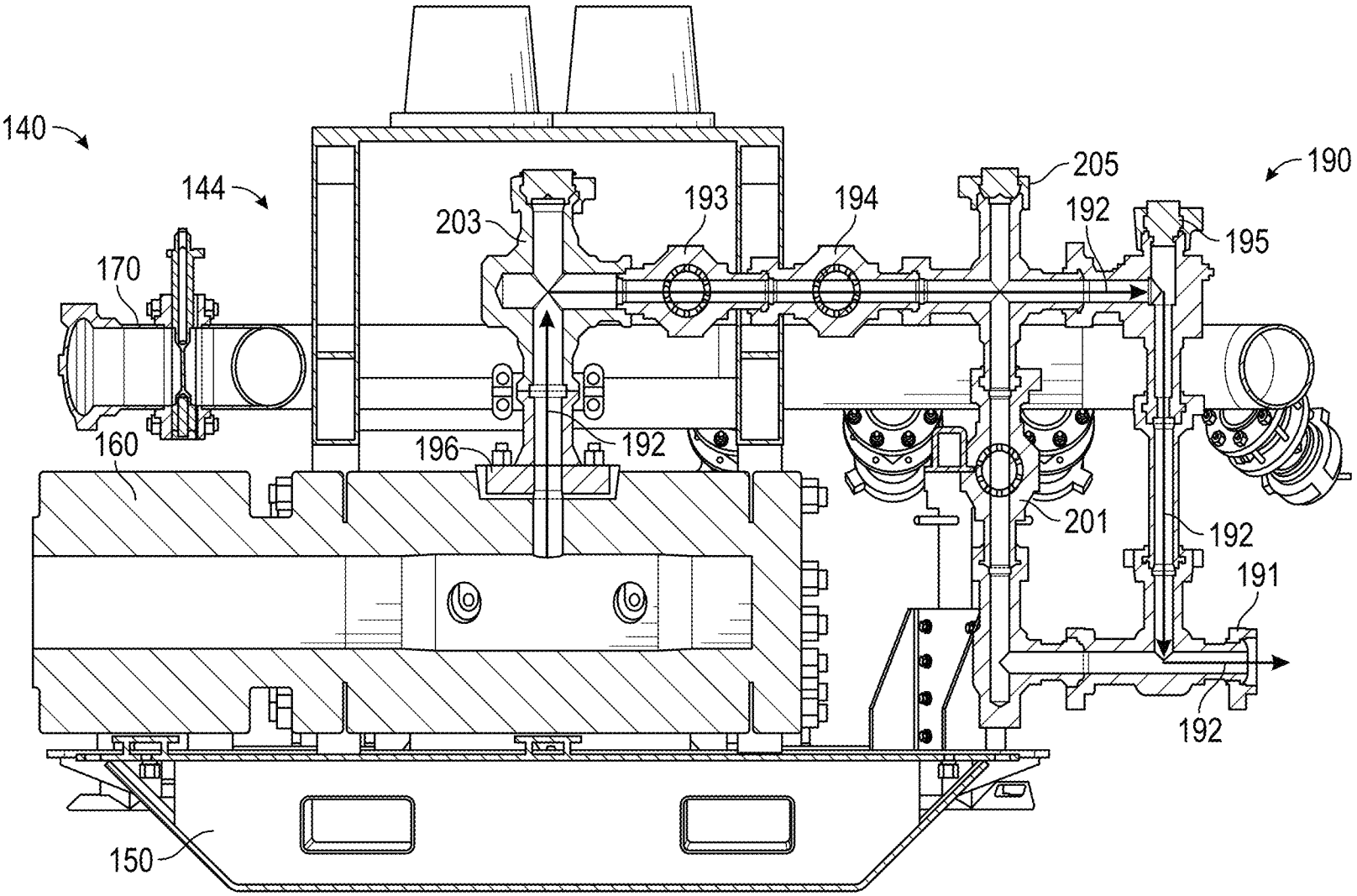
FIG. 6 is a side view of one illustrative embodiment of a modular pump manifold structure with the bleed off functionality and structure disclosed herein.
Figure 7:
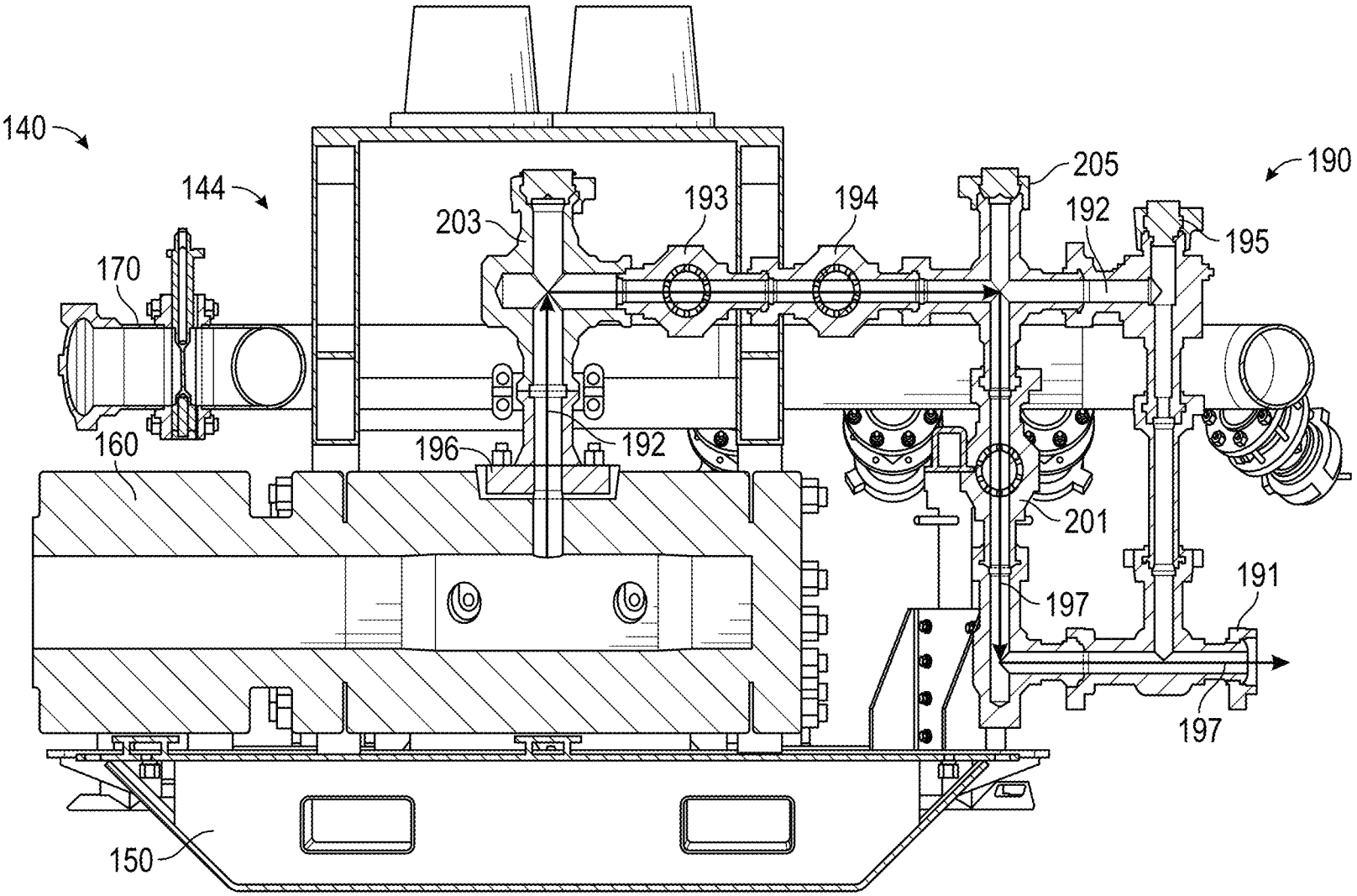
FIG. 7 is a side view of one illustrative embodiment of a modular pump manifold structure with the prime up functionality and structure disclosed herein.

FIG. 5 is a simple schematic diagram of the modular system 140 with bleed-off and prime-up functionalities. FIGS. 6 and 7 are, respectively, side views of illustrative arrangements of a bleed-off and prime-up process using the modular pump manifold 144 and the bleed-off/prime-up manifold 190. A particular modular pump manifold 144 that is isolated from the frac spread has the functionality to be bled-off and primed-up independently of the other modular pump manifolds 144 that are in the active fracing stage in the modular manifold system 140. The bleed-off operation releases the pressure within the high-pressure manifold 160, flow lines 126 and frac pumps 124 associated with a particular modular pump manifold 144. The bleed-off operation must be done safely and with a high degree of control to avoid the effect of sudden depressurization, which may create shock forces and fluid-disposal hazards.

As an example, the high-pressure fluid in the high-pressure manifold 160, flow lines 126 and frac pumps 124 that is isolated from the main high-pressure manifold 165 by the isolation valve 168, may be bled-off via the bleed-off/prime-up manifold 190 that is connected to the discharge line 191. In general, the bleed-off/prime-up manifold 190 includes a manifold inlet 196, a high-pressure mainline transducer 203, plug valves 193, 194, a downstream pressure transducer 205, a choke 195, and a bypass valve 201. In an embodiment, there is an inside plug valve 193 and an outside plug valve 194 located between the high-pressure manifold 160 and the discharge line 191. In an example embodiment, the plug valves 193, 194 may be hydraulic or air operated. In an example embodiment, the valves 193, 194 are 1×2 ULT plug valves.

The high-pressure fluid in the high-pressure manifold 160, flow lines 126 and frac pumps 124 associated with a particular modular pump manifold 144 will flow through the manifold inlet 196 of the high-pressure manifold 160 and into the mainline transducer 203 of the bleed-off/prime-up manifold 190 (arrows 192 in FIG. 6 illustrates the fluid flow direction and pathway in the bleed-off process). The high-pressure fluid will then flow through the actuated open plug valves 193, 194 and through the choke 195 that allows a particular modular pump manifold 144 to bleed-off in a slow and controlled manner. In an example embodiment, the choke 195 may be an inline fixed choke. The bypass valve 201 on the bleed off/prime-up manifold 190 is actuated closed when the bleed-off operation is performed on a particular modular pump manifold 144 to force the discharged fluid through the choke. The discharged fluid is then plumbed through the discharge line 191 to a nearby open-top tank 109. After the bleed-off process is complete, an operator may safely access the pumps 124 of the particular modular pump manifold 144 while the other modular pump manifolds 144 may continue in the fracing stage. The operator may now perform pump maintenance such as repairing or replacing valves, seats, packing, pumps and high pressure/low pressure lines.

In an example embodiment, the modular manifold system 140 incorporates a variable bore ram system to support flexible high-pressure lines that makes it easy to connect directly to the discharge connection of a fluid end. In addition, at the end of each flexible line is an external connection that allows the operator to either directly perform a seal test via a hand pump, or remotely perform a seal test via an automated seat test circuit. This example embodiment allows operators to quickly replace pumps out during the active fracing stage and reduce nonproductive down time between stages. Of course, those skilled in the art will appreciate that other similar systems and equipment may be used to achieve similar results.

After maintenance and replacing or repairing frac pumps 124, an operator can commence the prime-up operations on a particular modular pump manifold 144 independently of the modular manifold system 140 that may be in the active fracing stage. In an example embodiment, to slowly prime-up the pumps, clean water may be supplied by the clean water header 117 via a dedicated low-pressure flow line 127 to a particular modular pump manifold 144 as described above. In addition, the operator actuates to open the inside plug valve 193, the outside plug valve 195 and also the bypass valve 201 (arrows 197 in FIG. 7 illustrates the fluid flow direction and pathway in the prime-up process). The bypass valve 201 is used to avoid fluid flow through the choke 195 because it is restrictive and may cause pressure issues. The discharged fluid used for the prime-up will flow through the discharge line 191 to a nearby open-top tank 109. This allows the frac pumps 124 being primed to be in fluid communication to the blender 112 and/or to the open top tank 109. The operator may perform pressure tests of the particular modular pump manifold 144 to ensure that the modular pump manifold 144 is ready for the active fracing stage. In an example embodiment, the modular manifold system 140 includes a utility skid 211 that may be used to perform pressure tests of the particular modular pump manifold 144 and other operations that would be appreciated by those skilled in the art. When the prime-up process is completed, the inside plug valve 193, the outside plug valves 194, and the bypass valve 201 are closed. Lastly, to bring a modular pump manifold 144 back online into the active fracing stage, an operator equalizes the pressure on both sides of the isolation valve 168, meaning the main high-pressure manifold 165 side and the high-pressure manifold 160 side, and opens the isolation valve 168 to allow fluid communication of the modular pump manifold 144 to the main high-pressure manifold 165.

As described above, embodiments herein include modular "manifolds" that may be fluidly isolated from other modular pump manifolds in the system, such that maintenance may be performed on equipment of a manifold while continuing operations using the remaining manifold. Each modular pump manifold may include a first modular pump manifold that may include a low-pressure manifold configured to supply a fracturing fluid or clean water to a suction side of two or more frac pumps and a high-pressure manifold configured to receive a discharge of the one or more frac pumps. The system may include a bleed off/prime up manifold configured to bleed off pressure from the high-pressure manifold and to prime up pressure in the high-pressure manifold. The system may further include one or more additional modular pump manifolds that each may include a low-pressure manifold configured to supply a fracturing fluid or clean water to a suction side of two or more frac pumps, a high-pressure manifold configured to receive a discharge of the two or more frac pump and a bleed off/prime up manifold configured to bleed off pressure from the high-pressure manifold and to prime up pressure in the high-pressure manifold, a main high-pressure manifold fluidly connected to and configured to receive the discharge from the high-pressure manifolds of the modular pump manifold and the one or more modular pump manifolds, a main low pressure-header configured to supply the fracturing fluid from a supply system to each of the low-pressure manifolds, a water header configured to supply water from a water supply system to each of the low-pressure manifolds where the main low-pressure header and the water header may be fluidly connected to a common flow line, and where each common flow line is fluidly connected to a respective one of the low-pressure manifolds.

Two or more modular pump manifolds may be used to supply a high pressure fluid to a downstream system, such as for supplying a fracturing fluid to one or more wells. The system for supplying a fracturing fluid to the one or more wells may include, for example, one or more pumps, a low-pressure header, two or more high-pressure manifolds, and a main high-pressure manifold. The low-pressure header may be configured to distribute a fracturing fluid and water, individually or collectively, to the two or more modular pump manifolds and therefrom to low pressure inlets of the one or more pumps associated with the respective manifold. The two or more high-pressure manifolds are each respectively configured to receive a discharge from each of the one or more pumps of a respective manifold. The main high-pressure manifold is configured to receive a discharge from each of the two or more high-pressure manifolds, and the main high-pressure manifold may be fluidly connected to one or more wells.

Each modular pump manifold may be fluidly isolatable from the other modular pump manifolds. In some embodiments, each modular pump manifold may include two or more pumps.

The low-pressure header of the system may include a frac fluid header configured to receive a slurry from a slurry supply system. Supply lines are provided, each fluidly connecting the frac fluid header to a respective one of the two or more modular pump manifolds. Further, a water header is configured to receive water from a water supply system, and water supply lines are provided, each fluidly connecting the water header with a respective one of the supply lines.

The low-pressure header of the system may further include valves disposed on each of the supply lines and each of the water supply lines, where the valves are configured to permit or restrict flow of slurry or water, respectively, from the frac fluid header and the water header to the associated modular pump manifolds.

In some embodiments, the system for supplying a fracturing fluid to the one or more wells may include a bleed-off/prime-up manifold, where each bleed-off/prime-up manifold may include an inlet fluidly connected to the high-pressure manifold, an outlet, a first flow line fluidly connecting the inlet and the outlet, and a second flow line fluidly connecting the inlet and the outlet. A valve is disposed on the first flow line and a choke is disposed on the second flow line.

The system for supplying a fracturing fluid to the one or more wells may include a blender configured to blend water and proppant to form the fracturing fluid. A flow line fluidly connecting the blender with the low-pressure header may be used for supplying the fracturing fluid from the blender to the low-pressure header. A water supply system configured to supply water to the blender may be used to supply water to the low-pressure header. The system may further include a pump, disposed downstream of the water supply system and upstream of the low-pressure header, configured to increase a pressure of the water supplied to the low-pressure header.

In an embodiment, each of the two or more modular pump manifolds that may be used to supply a high-pressure fluid may include a low-pressure manifold fluidly connected to the low-pressure header and flow lines fluidly connecting the low-pressure manifold to an inlet of a respective one of the one or more pumps to supply fracturing fluid and clean water from the low-pressure manifold to a suction side of each pump of the respective modular pump manifold.

The above described systems may be used in methods for fracturing one or more wells. The method for fracturing one or more wells may include, for example, supplying a fracturing fluid to two or more modular pump manifolds via a low-pressure header, increasing a pressure of the fracturing fluid using one or more pumps associated with each modular pump manifold to supply a high pressure fracturing fluid to a main high-pressure manifold, discontinuing supply of the fracturing fluid to a first manifold of the two or more modular pump manifolds, supplying water to the first manifold via the low-pressure header while continuing to supply the fracturing fluid to a remainder of the two or more modular pump manifolds via the low-pressure header, flushing fracturing fluid from the first manifold using the water and fluidly isolating the first manifold from the main high-pressure manifold. The method for fracturing one or more wells may include the flushing of fracturing fluid comprises discharging water from the first manifold into the main high-pressure. The method for fracturing one or more wells may include fluidly isolating the first manifold, bleeding off pressure in one or more fluid conduits of the first manifold, and performing one or more maintenance procedures on equipment of the first manifold. After completing one or more maintenance procedures described, the method may further include, supplying water to the first manifold, priming pumps of the first manifold, discontinuing supply of water to the first manifold, supplying a fracturing fluid to the first manifold, and feeding pressurized fracturing fluid from the first manifold to the main high-pressure manifold.

As will be appreciated by those skilled in the art after a complete reading of the present application, the use of the terms "high-pressure" and "low-pressure," e.g., as in "high-pressure manifold" and "low-pressure manifold," is intended to only be descriptive of the component and their position within the systems disclosed herein. That is, the use of such terms should not be understood to imply that there is a specific operating pressure or pressure rating for such components. For example, the term "high-pressure manifold" should be understood to refer to a manifold that receives pressurized fracturing fluid that has been discharged from a frac pump irrespective of the actual pressure of the fracturing fluid as it leaves the pump or enters the manifold. Similarly, the term "low-pressure manifold" should be understood to refer to a manifold that receives fracturing fluid and supplies that fluid to the suction side of the frac pump irrespective of the actual pressure of the fluid within the low-pressure manifold.

The particular embodiments disclosed above are illustrative only, as the disclosed subject matter may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the claimed subject matter. Note that the use of terms, such as "first," "second," "third" or "fourth" to describe various processes or structures in this specification and in the attached claims is only used as a shorthand reference to such steps/structures and does not necessarily imply that such steps/structures are performed/formed in that ordered sequence. Of course, depending upon the exact claim language, an ordered sequence of such processes may or may not be required. Accordingly, the protection sought herein is as set forth in the claims below.

What is claimed as new and desired to be protected by Letters Patent of the United States is:

1. A method, comprising:

connecting modular pump manifolds to a main high-pressure manifold to provide a modular manifold system, wherein each modular pump manifold is fluidly connected to a frac fluid source and a water source via a low-pressure header, and wherein each modular pump manifold is connected to multiple pumps;

supplying a fracturing fluid to two or more of the modular pump manifolds via the low-pressure header;

discontinuing supply of the fracturing fluid to a first modular pump manifold of the two or more modular pump manifolds while continuing to supply the fracturing fluid to a remainder of the two or more modular pump manifolds via the low-pressure header; and supplying clean water to the first modular pump manifold via the low-pressure header to flush the fracturing fluid from the first modular pump manifold.

2. The method of claim 1, further comprising pressurizing the clean water used to flush the fracturing fluid from the first modular pump manifold, producing a pressurized clean water.

3. The method of claim 2, further comprising directing the pressurized clean water used to flush the fracturing fluid from the first modular pump manifold to a high-pressure manifold on each of the two or more of the modular pump manifolds.

4. The method of claim 3, further comprising directing the pressurized clean water from the high-pressure manifold on each of the two or more of the modular pump manifolds through an isolation valve in an open position to a well.

5. The method of claim 1, further comprising:

bleeding off pressure in one or more fluid conduits of the first modular pump manifold; and performing one or more maintenance procedures on a first pump of the multiple pumps connected to the first modular pump manifold without disconnecting the first pump from the first modular pump manifold.

6. The method of claim 5, further comprising, after the one or more maintenance procedures are completed:

supplying water to the first modular pump manifold;

priming the multiple pumps connected to the first modular pump manifold;

discontinuing the supply of the water to the first modular pump manifold;

supplying the fracturing fluid to the first modular pump manifold; and feeding pressurized fracturing fluid from the first modular pump manifold to the main high-pressure manifold.

7. A method, comprising:

connecting modular pump manifolds to a main high-pressure manifold to provide a modular manifold system, wherein each modular pump manifold is fluidly connected to a frac fluid source and a water source via a low-pressure header, and wherein each modular pump manifold is connected to multiple pumps;

supplying a fracturing fluid to two or more of the modular pump manifolds via the low-pressure header;

discontinuing supply of the fracturing fluid to a first modular pump manifold of the two or more modular pump manifolds while continuing to supply the fracturing fluid to a remainder of the two or more modular pump manifolds via the low-pressure header;

supplying clean water to the first modular pump manifold via the low-pressure header to flush the fracturing fluid from the first modular pump manifold;

pressurizing the clean water used to flush the fracturing fluid from the first modular pump manifold, producing a pressurized clean water;

directing the pressurized clean water used to flush the fracturing fluid from the first modular pump manifold to a high-pressure manifold on each of the two or more of the modular pump manifolds; and directing the pressurized clean water from the high-pressure manifold on each of the two or more of the modular pump manifolds through an isolation valve in an open position to a well.

8. The method of claim 7, further comprising:

bleeding off pressure in one or more fluid conduits of the first modular pump manifold; and performing one or more maintenance procedures on a first pump of the multiple pumps connected to the first modular pump manifold without disconnecting the first pump from the first modular pump manifold.

9. The method of claim 8, further comprising, after the one or more maintenance procedures are completed:

supplying water to the first modular pump manifold;

priming the multiple pumps connected to the first modular pump manifold;

discontinuing the supply of the water to the first modular pump manifold;

supplying the fracturing fluid to the first modular pump manifold; and feeding pressurized fracturing fluid from the first modular pump manifold to the main high-pressure manifold.

10. A method, comprising:

connecting modular pump manifolds to a main high-pressure manifold to provide a modular manifold system, wherein each modular pump manifold is fluidly connected to a fracturing fluid source and a water source via a low-pressure header, and wherein each modular pump manifold is connected to multiple pumps;

supplying a fracturing fluid to two or more of the modular pump manifolds via the low-pressure header;

increasing a pressure of the fracturing fluid using the multiple pumps connected to each modular pump manifold to supply a pressurized fracturing fluid to the main high-pressure manifold;

discontinuing supply of the fracturing fluid to a first modular pump manifold of the two or more modular pump manifolds while continuing to supply the fracturing fluid to a remainder of the two or more modular pump manifolds via the low-pressure header;

fluidly isolating the first modular pump manifold from the main high-pressure manifold; and supplying clean water to the first modular pump manifold via the low-pressure header to flush the fracturing fluid from the first modular pump manifold.

11. The method of claim 10, further comprising:

bleeding off residual pressure in one or more fluid conduits of the first modular pump manifold.

12. The method of claim 11, wherein bleeding off the residual pressure is performed through a controlled valve disposed in fluid communication with the first modular pump manifold.

13. The method of claim 12, further comprising:

performing one or more maintenance procedures on at least one of the multiple pumps connected to the first modular pump manifold without disconnecting the at least one of the multiple pumps from the first modular pump manifold.

14. The method of claim 13, further comprising:

after the one or more maintenance procedures are completed, priming the multiple pumps connected to the first modular pump manifold with the clean water.

15. The method of claim 14, further comprising:

closing the controlled valve; and feeding the pressurized fracturing fluid from the first modular pump manifold to the main high-pressure manifold.

16. The method of claim 10, further comprising:

pressurizing the clean water used to flush the fracturing fluid from the first modular pump manifold, producing a pressurized clean water.

17. The method of claim 16, further comprising:

opening an isolation valve in fluid communication with the first modular pump manifold and the main high-pressure manifold; and directing the pressurized clean water to the main high-pressure manifold.

18. The method of claim 17, further comprising:

directing the pressurized clean water from the main high-pressure manifold to a well.

19. The method of claim 10, further comprising:

supplying the fracturing fluid to the low-pressure header from a blender configured to blend water and proppant to form the fracturing fluid.

20. The method of claim 19, wherein the blender is fluidly connected to the low-pressure header via a flow line, and a water supply system is configured to supply the water to the blender.

* * * * *